US006857935B1

(12) United States Patent
Dohan

(10) Patent No.: US 6,857,935 B1
(45) Date of Patent: Feb. 22, 2005

(54) REUSABLE ADHESIVE BODY APPAREL

(76) Inventor: Jewel L. Dohan, 398 Villa Point Dr., Newport Beach, CA (US) 92660

( * ) Notice: Subject to any disclaimer, the term of this patent is extended or adjusted under 35 U.S.C. 154(b) by 0 days.

(21) Appl. No.: 10/714,250

(22) Filed: Nov. 14, 2003

(51) Int. Cl.[7] ..... A41C 3/00

(52) U.S. Cl. ..... 450/81; 2/244; 2/246; 450/1

(58) Field of Search ..... 450/1, 81; 602/41–59; 2/246, 244, 69, 400, 403, 406, 46; 428/16–18, 24–26, 29, 542.2, 542.6

(56) References Cited

U.S. PATENT DOCUMENTS

| | | | | | |
|---|---|---|---|---|---|
| 4,333,471 | A | | 6/1982 | Nakai | 128/505 |
| 4,594,276 | A | * | 6/1986 | Relyea | 428/42.1 |
| 4,640,288 | A | * | 2/1987 | Hattori | 450/81 |
| 5,421,765 | A | * | 6/1995 | Lehmann et al. | 446/296 |
| 5,817,385 | A | * | 10/1998 | Stanislav | 428/40.2 |
| 5,998,693 | A | | 12/1999 | Zagame | 602/52 |
| 6,048,545 | A | * | 4/2000 | Keller et al. | 424/450 |
| 6,200,195 | B1 | | 3/2001 | Furuno et al. | 450/81 |
| 6,207,874 | B1 | * | 3/2001 | Felton et al. | 602/42 |
| 6,241,715 | B1 | * | 6/2001 | Houser et al. | 604/385.07 |
| 6,371,831 | B1 | * | 4/2002 | Dodge | 450/81 |
| 6,455,752 | B1 | * | 9/2002 | Vesey | 602/41 |
| 6,604,854 | B1 | * | 8/2003 | Limburg et al. | 374/162 |
| 6,699,569 | B2 | * | 3/2004 | Lipper | 347/105 |
| 2003/0224700 | A1 | | 12/2003 | Chen | 450/88 |

OTHER PUBLICATIONS

Three page printout entitled "Nippies™", printed on Sep. 15, 2003. Applicant is unaware of the author or publication date of the document.

Three page printout regarding "Topless Sandals" printed on Oct. 7, 2003 from a website having an URL: http://www.toplesssandals.com. Applicant is unaware of the author or publication date of the document.

Two page printout regarding "The Original Stickyshoe" printed on Oct. 7, 2003 from a website having a URL: http://www.stickyshoes.com. Applicant is unaware of the author or publication date of the document.

One page printout entitled "NuBra" printed on Jan. 7, 2004 from a website having a URL: http://www.thenubra.com. Applicant is unaware of the author or publication date of the document. The document has a 2002 copyright.

Two page printout entitled "Introducing NuBra" printed on Jan. 7, 2004 from a website having a URL: http://www.nubra.net/nubra_instructions.html. Applicant is unaware of the author or publication date of the document. The document has a 2002 copyright.

Three page printout entitled "NuBra: Stick it and forget it" printed on Jan. 7, 2004 from a website having a URL: http://www.myrtlebeachonline.com/mld/observer/living/6394583.htm. The author is Elizabelth Wellington. The article was posted on Jul. 27, 2003 in The Charlotte Observer.

* cited by examiner

*Primary Examiner*—Gloria M. Hale
(74) *Attorney, Agent, or Firm*—Stout, Uxa, Buyan & Mullins, LLP; Greg S. Hollrigel

(57) ABSTRACT

Reusable adhesive body apparel is disclosed. The reusable adhesive body apparel includes a decorative component and an adhesive component coupled to the decorative component. The adhesive component is formed of a material that permits the apparel to be reused multiple times. In one configuration, the apparel includes an adhesive tape with a decorative image provided on a non-adhesive surface of the tape, and a gel coupled to the adhesive surface of the tape. In another configuration, the apparel includes a decorative component with an uneven surface topography, and an adhesive gel. The apparel may be used for any suitable purpose, for example, the apparel may be used as a breast cover, a bathing suit, a costume, or a tattoo.

20 Claims, 4 Drawing Sheets

REUSABLE ADHESIVE BODY APPAREL

FIELD OF THE INVENTION

The present invention relates to adhesive body apparel. More specifically, the present invention relates to body apparel that has an adhesive component that permits the apparel to be applied and removed from a body surface multiple times.

BACKGROUND

Adhesive body apparel refers to many different types of products that adhere to a person's body. The apparel may be used instead of, or as an accessory to, clothing. Body apparel is often worn to provide a decorative or fashionable appearance to a person wearing the apparel. For example, a temporary tattoo may be considered adhesive body apparel because it is applied to a person's skin with the use of water to allow a tattoo image to adhere to the skin. Tattoos are not reusable because they are typically completely destroyed as they are removed from a person's skin. In addition, a nipple or a breast cover may be considered adhesive body apparel. Nipple covers that many women wear are designed for a single use. In that regard, existing nipple covers use an adhesive that loses most, if not all, of its adhesive properties after removal from a woman's skin. Current nipple covers are not guaranteed to be reusable. In addition, the adhesive used in conventional nipple covers requires substantial amounts of care in application and removal, especially since adhesive nipple covers tend to cause pain or discomfort when they are removed from sensitive regions of a person's body, such as a nipple.

Thus, there remains a need in the art for adhesive body apparel that addresses the shortcomings associated with existing adhesive body apparel.

SUMMARY

The present invention disclosed herein relates to body apparel, such as clothing, costumes, and the like. More specifically, the invention relates to body apparel which is adhesively applied to a body surface, such as a body surface of a person, and remains fixed thereon for extended periods of time. The apparel can be removed and reapplied multiple times, and can be reused without causing significant amounts of discomfort to the person wearing the apparel. Reuse of the apparel does not require any particular preparation or care of the skin on which the apparel is placed or of the apparel itself.

As used herein, the phrase "body apparel" refers to any attire that may be worn by a person to conceal one or more portions of the person's body. People generally prefer to wear attire which provides certain desirable aesthetic effects. Accordingly, in reference to the disclosure herein, "body apparel" specifically excludes non-decorative or non-fashionable items, such as reusable medical electrodes, bandaids, and other medical devices. "Body apparel", as used herein, also refers to a single element, or multiple elements; thus, the term "body apparel" is understood to refer one or more elements which may be placed on a person's body.

Generally, reusable adhesive body apparel in accordance with the disclosure herein includes a decorative component and an adhesive component. The decorative component is configured, formed, or shaped to provide a decorative appearance to a body surface on which the apparel is applied. The adhesive component is coupled to the decorative component. The adhesive component facilitates adhesion of the decorative component to the body surface. The adhesive component is formed of a material that enables the apparel to adhere to the body surface at least one additional time after removal from the body surface. In other words, the apparel can be applied and removed from the body surface multiple times, such as two or more times, as desired. Advantageously, the apparel can be removed from the body surface of a person without causing significant amounts of pain to the person, and the apparel can be reapplied on the person without requiring substantial modification to the adhesive component, or to the person's skin.

Additional features and advantages of the present invention are disclosed in the following detailed description and claims. Any feature or combination of features described herein are included within the scope of the present invention provided that the features included in any such combination are not mutually inconsistent as will be apparent from the context, this specification, and the knowledge of one of ordinary skill in the art. In addition, any feature or combination of features may be specifically excluded from any embodiment of the present invention.

DETAILED DESCRIPTION

The present invention disclosed herein relates to reusable adhesive body apparel. The body apparel of the present invention is fashionable and may be worn in lieu of, or in addition to, regular clothing or attire that a person may wear. In addition, the body apparel may be used as a costume and the like for events such as Halloween and costume parties. The body apparel disclosed herein is easy to manufacture, easy to use, and provides an alternative to conventional attire.

The body apparel disclosed herein is adhesive and reusable. The body apparel is applied to a body surface by placing an adhesive portion of the apparel on a body surface. The body surface is typically a body of a person, but when the apparel is used for modeling or display purposes, the body surface may also include surfaces of inanimate objects, such as mannequins and the like. When the apparel is placed on a body surface, the apparel remains in a substantially fixed position on the body surface. In other words, the apparel does not inadvertently move from one region of the body to another region. In addition, substantially all of the apparel remains in contact with the body surface when it is adhered thereto.

When a person wishes to remove the apparel, the apparel may be grasped by its edge and "peeled" from the body surface. Importantly, removal of the body apparel does not cause or result in significant pain or discomfort to a person wearing the apparel, and in certain embodiments, removal occurs without any pain, even when the apparel is removed rapidly. Unlike existing products, the apparel disclosed herein is reusable, or stated differently, the apparel may be applied and removed multiple times, and preferably, may be reused indefinitely without substantial modification to the apparel. For example, the adhesive component does not need to be warmed to be reapplied to a body surface. In addition, the adhesive component and/or the body surface does not necessarily need to be washed or cleaned before the apparel is applied or reapplied to the body surface. Because the apparel may be in direct contact with the skin of a person, the materials of the apparel are desirably non-bioreactive. Thus, the application and removal of the apparel from a person results in minimal, if any, adverse reaction, such as skin irritation or discoloration, from the products. In certain embodiments of the apparel, the decorative component and the adhesive component are made from medical grade products, as discussed herein.

Figure 1A:
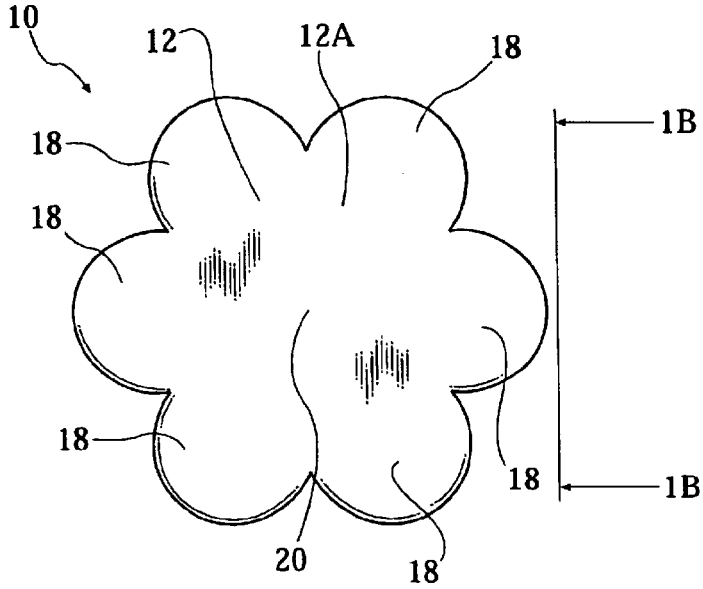
FIG. 1A is a front plan view of reusable adhesive body apparel in accordance with the disclosure herein.
Figure 1B:
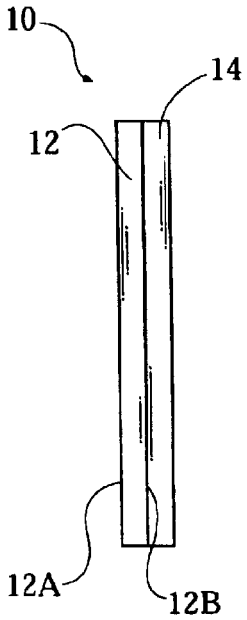
FIG. 1B is a side plan view of the apparel of FIG. 1A.
Figure 1C:
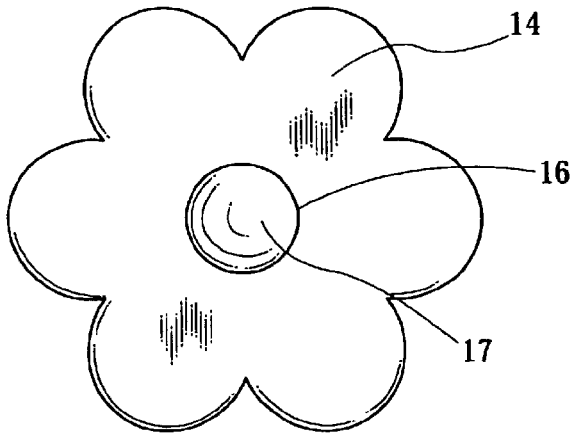
FIG. 1C is a rear plan view of the apparel of FIG. 1A.

Referring to the figures, and specifically FIGS. 1A–1C, a reusable adhesive body apparel 10 is shown. Reusable adhesive body apparel comprises a decorative component 12 and an adhesive component 14 (see FIG. 1B). The adhesive component 14 is a portion of the apparel 10 that contacts a body surface when the apparel 10 is normally worm. The decorative component 12 is configured, shaped, or otherwise designed to provide a decorative appearance to a body surface on which the apparel is applied. In the embodiment illustrated in FIG. 1A, the apparel 10 includes a decorative component having six generally semi-circular members 18 circumferentially arranged around a central region 20. The decorative component 12 thus provides an appearance of a six-petal flower.

The adhesive component 14 is coupled or otherwise attached to the decorative component 12 to facilitate adhesion of the decorative component to the body surface. The adhesive component is formed of a material that enables the apparel to adhere to a body surface, such as skin of a person, and be removed therefrom multiple times. In other words, the adhesive component 14 is made of a material that enables the apparel to adhere to the body surface at least one additional time after removal from the body surface. In preferred embodiments, the apparel may be reused, for example, used two or more times, and more preferably, the apparel may be reused indefinitely by maintaining the adhesive properties of the adhesive component 14, for example, by maintaining a moisture content of the adhesive component so that it remains adhesive. The moisture content can be controlled by controlling the amount of water present in the adhesive component, for example. Importantly, the adhesive component 14 is formed of a material which permits the apparel 10 to be applied and removed from a body surface without requiring substantial modification to the adhesive component. For example, the apparel 10 may be applied to and removed from a body surface multiple times, such as more than two times, by placing the adhesive component 14 in contact with a body surface and by lifting the apparel 10 from the body surface to remove it. It is not necessary, and is preferable, not to require warming of the adhesive component when reapplying the apparel to a body surface. When not in use, the apparel 10 may be placed on a backing substrate, such as a wax paper or plastic sheet, by placing the adhesive component on the backing substrate.

Depending on the particular type of apparel desired, the decorative component 12 may be formed as a relatively thin sheet of material, or it may be formed as a three-dimensional object, such as an object having a substantial thickness. Thus, the decorative component 12 may be planar or flat, or it may include a surface with an uneven or non-flat surface topography.

In the embodiment illustrated in FIGS. 1A–1C, the decorative component 12 is substantially flat when the body apparel 10 is placed on a substantially flat surface, such as a table, a window, and the like. As discussed herein, the body apparel 10 may be placed on a curved body surface, and accordingly, the decorative component 12, in such a placement, would assume a curved configuration. In other words, the decorative component 12 may assume a configuration or shape similar to the shape of the surface on which the apparel 10 is applied. Thus, the decorative component 12 may include a flexible material which permits the apparel 10 to flex and bend so that substantially all of the adhesive component 14 remains in contact with a body surface when placed thereon.

In at least one embodiment of the apparel 10, the decorative component 12 comprises a decorative image provided on an adhesive tape. The decorative image may be provided on the tape using any suitable process, including printing, painting, dyeing, sewing, and the like. In one embodiment, the decorative image is a print of a digital image of an object. The digital image may be any image that can be stored on a computer or computer-like device. Thus, the digital image includes, but is not limited to, digital photographs, scanned images obtained with a conventional scanner, digital drawings, and the like. The digital image may be printed on the tape using any conventional technique and device. For example, the decorative image may be printed onto the tape using an ink jet printer, which may be coupled to a conventional personal computer. Or, the decorative image may be printed on the tape using a commercial printing apparatus, which may provide enhanced printing capabilities.

Figure 3:
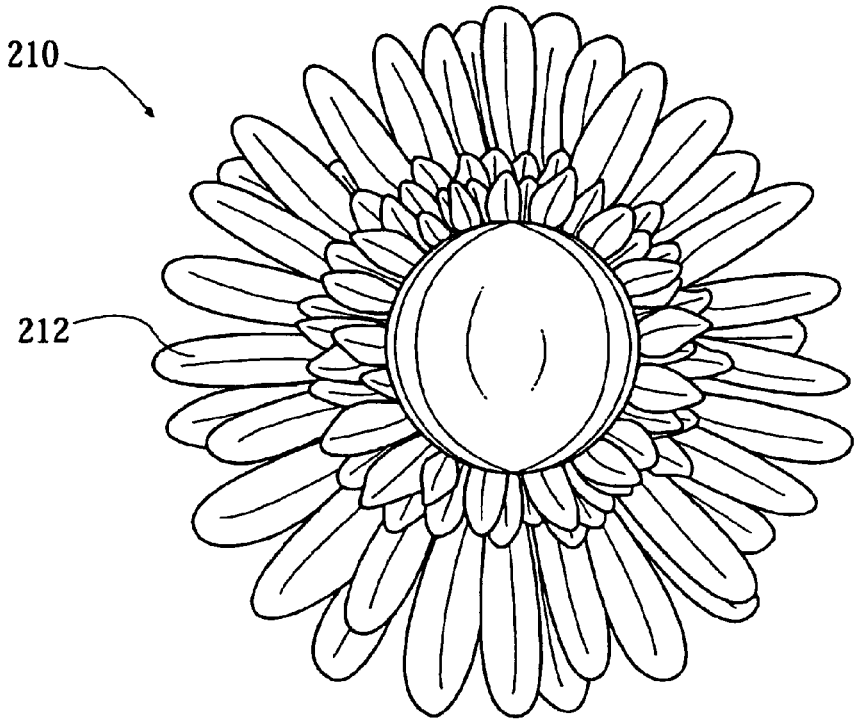
FIG. 3 is a front plan view of a reusable adhesive body apparel having a decorative component in the shape of a sunflower.
Figure 4:
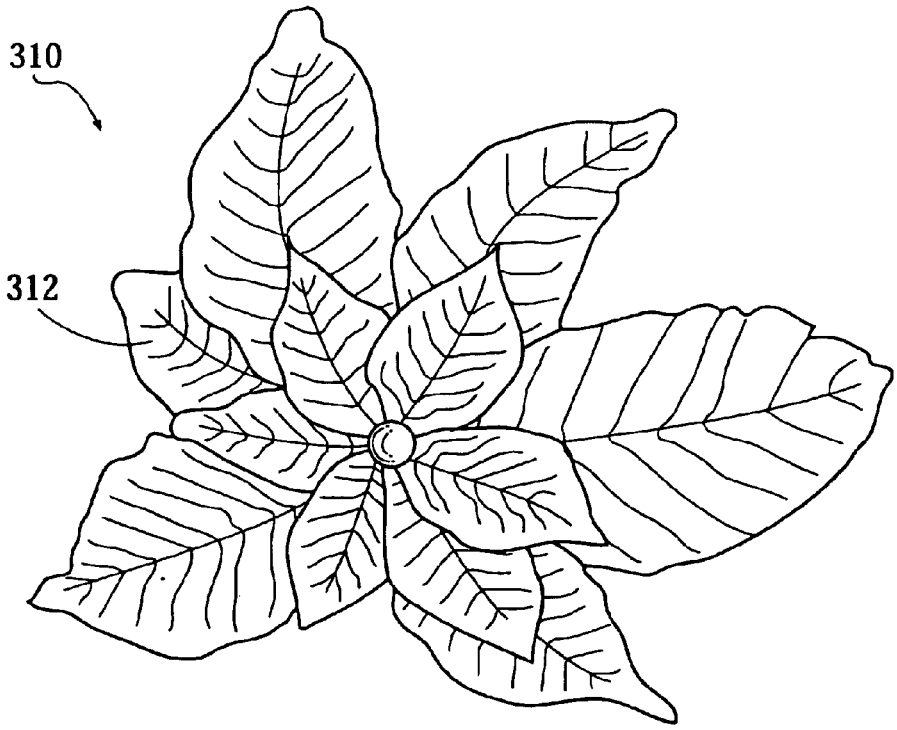
FIG. 4 is a front plan view of a reusable adhesive body apparel having a decorative component in a leaf configuration.
Figure 5:
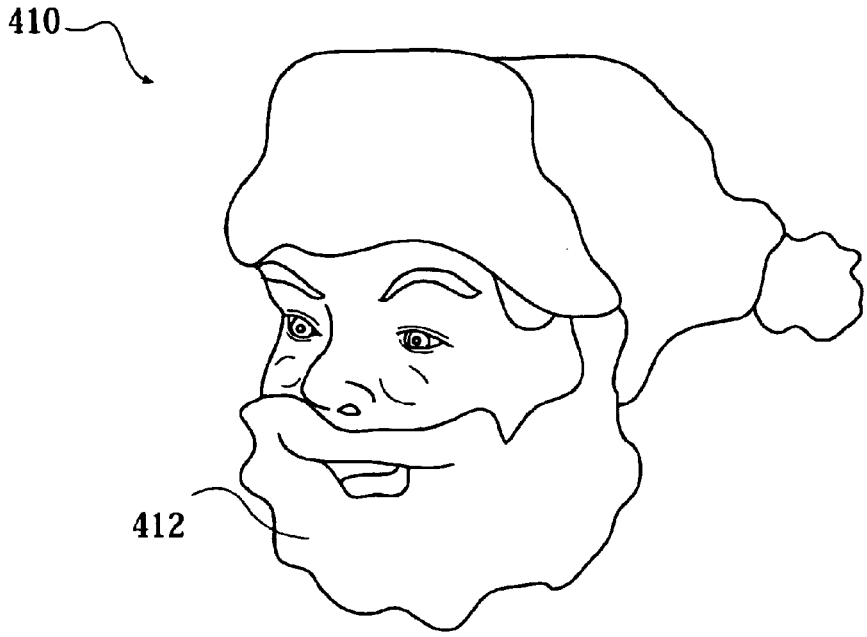
FIG. 5 is a front plan view of a reusable adhesive body apparel having a decorative component in the shape of Santa Claus.

The decorative image may be any image that provides a desired visual effect for the person wearing the apparel. As illustrated in FIG. 3 the decorative image may be an image of a flower, such as a sunflower. As shown in FIG. 4, the decorative image may be an image of one or more leaves. As shown in FIG. 5, the decorative image may be an image of a holiday character, such as Santa Claus. In additional embodiments, the decorative image may be obtained by shaping or cutting the tape in a particular configuration. For example, as shown in FIG. 1, the decorative image may be in the shape of a six petal flower. Or, as shown in FIG. 2, the decorative image may be in the shape of a spiral. Thus, in certain embodiments, the decorative image is an image of an object selected from the group consisting of plants, including flowers and leaves, animals, holiday characters, and spirals. When holiday characters are used, the decorative image may be an image of a Santa Claus, Mrs. Claus, Baby New Year, a leprechaun, a heart, an Easter bunny, an Easter egg, a flag, a ghost, a witch, a jack-o-lantern, a turkey, and the like. Any animal may be used as a decorative image, including cats, dogs, horses, lions, tigers, and the like. The image may comprise one or more colors depending on the image being depicted.

In the illustrated embodiment of the apparel, the decorative component 12 comprises a material having an adhesive surface 12*b* (see FIG. 1B) and a non-adhesive surface 12*a*. A decorative image, as discussed herein, is provided on the non-adhesive surface 12*a*. The adhesive component 14 is coupled to the adhesive surface 12*b* of the decorative component 12. Because the illustrated coupling between the decorative component 12 and the adhesive component 14 is by way of an adhesive provided on the decorative component 12, the present apparel is relatively easy to manufacture compared to other products which use alternative forms of coupling, such as co-molding or penetration or impregnation. For example, a layer of the adhesive component 14 can be placed over the adhesive surface 12*b* of the decorative component 12, and the two components 12 and 14 may be pressed together to form a laminated structure. The combination of components may be subsequently cut into a desired configuration, or the individual components may be cut prior to assembly. In addition, if a decorative image is provided on the non-adhesive surface 12*a* of the decorative component, the image may be applied either before or after the two components 12 and 14 are coupled together.

In certain embodiments, the decorative component comprises a tape having an adhesive surface and a non-adhesive surface, as indicated herein. In order to enhance the fitting effects of the apparel of these embodiments, the tape may be elastic or stretchable, thereby providing some resilience and flexibility in shaping the apparel on the body surface. To promote effective and desirable image properties, such as sharp detailed images, the tape may be made of a non-woven material, and in certain embodiments, the non-woven material is provided on the non-adhesive surface. In certain additional embodiments, the tape is breathable, or in other words, permits gas, such as air, to flow therethrough. Any tape having one or more of these features may be used in the manufacture of the apparel disclosed herein. In one embodiment, the tape of the apparel is publicly available from 3M Health Care (St. Paul, Minn.) and is identified as 3M No. 9907. Tapes that are useful in accordance with the apparel disclosed herein should be capable of bearing a detailed decorative image and should include an adhesive surface that securely holds the adhesive component 14 thereon so that removal of the apparel 10 from a body surface does not result in separation of the adhesive component 14 from the decorative component 12. Tapes used with the apparel disclosed herein are typically medically safe.

In certain embodiments of the apparel 10, the adhesive component comprises, consists essentially of, or consists of a water swellable polymer. More specifically, the adhesive component 14 may comprise, consist essentially of, or consist of a hydrogel. Hydrogels suitable with the body apparel disclosed herein are publicly available, and as indicated herein, preferably are non-bioreactive. Hydrogels may have a tackiness that is effective to prevent the apparel from inadvertently moving from the body surface to which it is applied but is also effective to reduce any discomfort when the apparel is removed from the body surface. Hydrogels that are useful may also have some rewettability properties and a high dry out resistance, which may be effective to retain the desired adhesive properties of the gel. One example of a suitable hydrogel is the AG603 sensing gel available from AmGel Technologies (Fallbrook, Calif.). Another example of a hydrogel useful with the present apparel is the RG63B hydrogel available from Ludlow Technical Products (Chicopee, Mass.).

The adhesive component 14 of the apparel 10 is typically relatively thin so as to reduce the visibility of the adhesive component when the apparel 10 is worn by a person. In certain embodiments, the adhesive component 14 has a thickness less than about 0.04 inches. In additional embodiments, the adhesive component 14 has a thickness of about 0.025 inches or less. To further reduce the visibility of the adhesive component, the adhesive component 14 may be dimensioned similar to the decorative component 12 so that little, if any, of the adhesive component 14 is visible when viewed from the front, such as shown in FIG. 1A. In addition, when the body apparel is worn under garments, such as a nipple cover worn under a blouse, the thickness of the apparel is such that the apparel is non-visible when a person is wearing clothes over the apparel. The thickness of the apparel may be reduced by reducing the thickness of either the adhesive component or the decorative component, or both.

Figure 6:
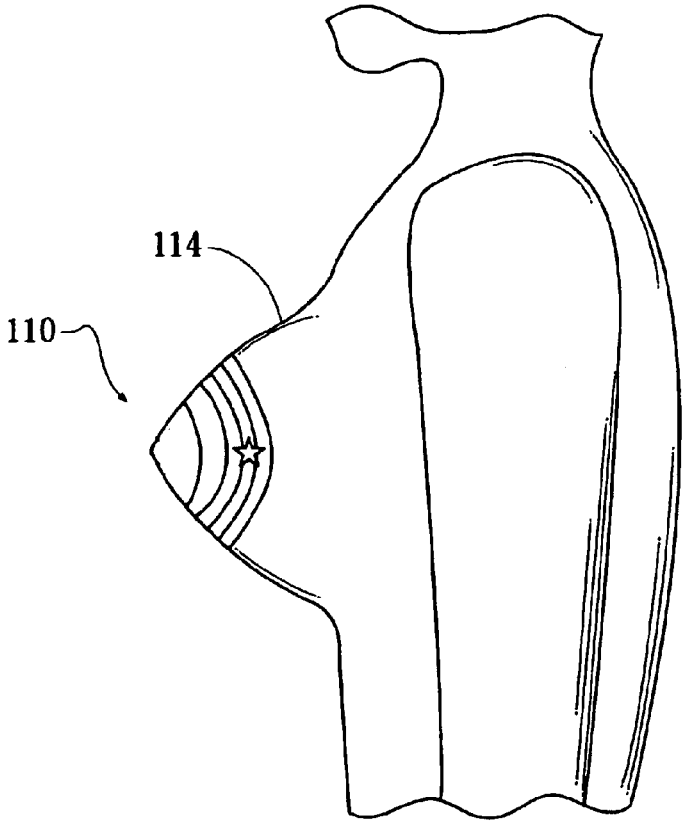
FIG. 6 is a side view of the apparel of FIG. 2B located on a body surface of a person.

As shown in FIG. 1C, the adhesive component may comprise an opening 16 that is positioned to provide a non-adhesive region 17 on the rear surface of the apparel 10. As illustrated, the non-adhesive region 17 is generally a portion of the adhesive surface 12*b* of the decorative component 12. The non-adhesive region 17 may include a portion that is devoid of adhesive used in the manufacture of adhesive surface 12*b*, or may include a non-adhesive material that is secured to a portion of the adhesive surface 12*b*. In the illustrated embodiment, the opening 16 is substantially located near the center of the apparel 10. Thus, this embodiment may be particularly useful to cover a sensitive region of a person, such as a nipple. Thus, the apparel 10 is dimensioned to cover a nipple of a man's or a woman's breast 114, as illustrated in FIG. 6. The apparel may range in size (e.g., in length, width, height, diameter, or area) from abut two inches to about five inches. In certain embodiments, the apparel may have a width and height of approximately three inches. The apparel may be provided with any color including metallic colors and neon-like colors. When using the apparel as a nipple cover, a woman may apply the apparel 10 to the breast by exposing the adhesive component (typically by removing a non-sticky backing substrate), applying a first portion of the apparel to a region of the breast below the nipple, and adhering the remaining portion of the apparel to the upper regions of the breast. This method has an advantage of enhancing the lift of a woman's breast without requiring a bra or other extraneous lifting device.

Figure 2A:
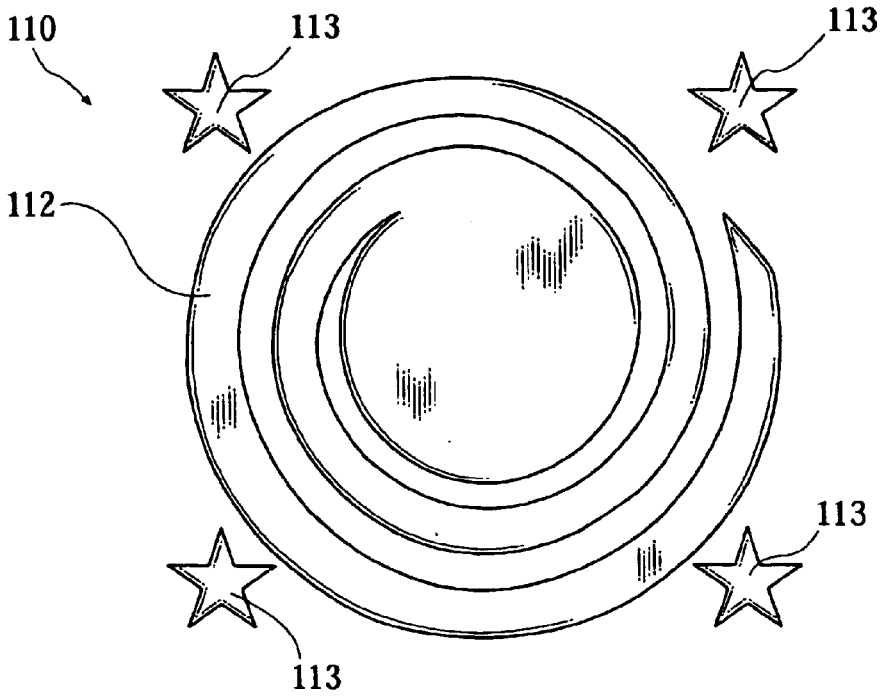
FIG. 2A is a front plan view of a multi-piece spiral shaped reusable adhesive body apparel.
Figure 2B:
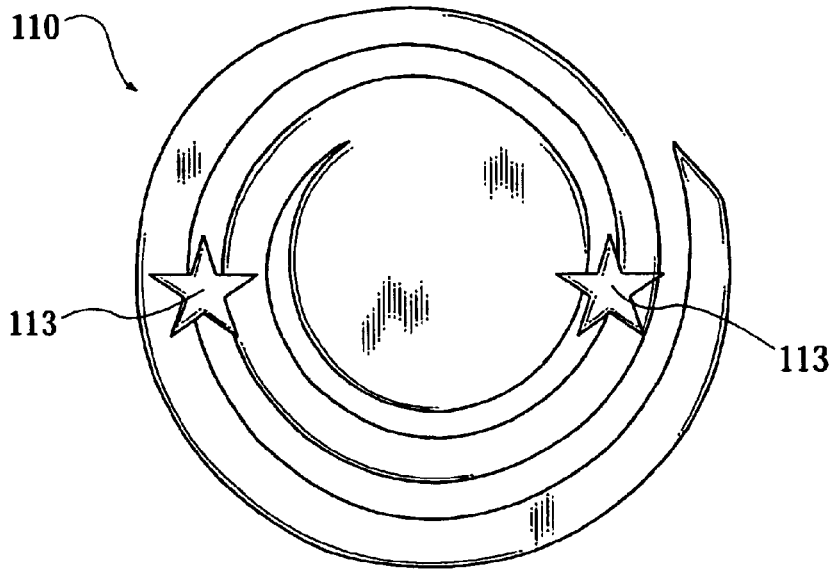
FIG. 2B is a front plan view of the apparel of FIG. 2A in a different configuration.

FIG. 2A illustrates another reusable adhesive body apparel 110. Apparel 110 is similar to the apparel 10, described herein, with a difference being that the decorative component 112 is generally configured as a spiral. As shown in FIG. 2A, the decorative component 112 is also illustrated as having multiple pieces, such as the stars 113. The stars 113 are separate elements that may be used alone or together with the spiral (as shown in FIG. 2B). Thus, the stars 113 may be used to help secure one or more strands of the spiral to a body surface, or they may be separately applied to a body surface.

FIG. 3 illustrates another reusable adhesive body apparel 210. Apparel 210 is similar to apparel 10 with a difference being that the decorative component 212 is cut in the shape of a sunflower, and includes an image of a sunflower provided thereon. FIG. 4 illustrates another reusable adhesive body apparel 310. Apparel 310 is similar to apparel 10 with a difference being that the decorative component 312 is cut in the shape of leaves, and includes an image of leaves provided thereon. FIG. 5 illustrates another reusable adhesive body apparel 410. Apparel 410 is similar to apparel 10 with a difference being that the decorative component 412 is cut in the shape of Santa Claus, and includes an image of Santa Claus provided thereon.

In one specific embodiment, the decorative component of the apparel consists of a is decorative image provided on a non-adhesive surface of an elastic, non-woven tape, and the adhesive component consists of a hydrogel layer placed on an adhesive surface of the elastic, non-woven tape.

In another embodiment of the apparel 10, the decorative component includes an exposed first surface when the apparel is applied to a body surface, and a non-exposed second surface coupled to the adhesive component of the apparel, wherein the exposed first surface has an uneven surface topography. Or, in comparison to the embodiment described hereinabove, the decorative component is a three dimensional object. For example, the decorative component may comprise a natural or a synthetic flower. Or, the decorative component may comprise a tassel extending from the exposed first surface, among other things.

In addition to being used as a nipple cover, the body apparel disclosed herein may also be used as a costume, such as a mask, and the like. For example, the body apparel may be dimensioned to cover substantially all of a persons face, or the body apparel may be dimensioned to cover a portion of the person's face, such as a chin, a cheek, a nose, a forehead, and the like. The apparel may also be used as a bathing suit. In one embodiment, when the apparel is shaped as a bikini bottom for a woman, the adhesive component of the apparel may be provided on only a portion of the apparel, such as one or more strips or portions located around the waist line of the bikini bottom. Advantageously, it has been discovered that once applied to a body surface, the adhesive properties of the adhesive component do not substantially change when the apparel is worn in water. In addition, the apparel may be used as a body tattoo. Advantageously, the tattoos can be easily applied and removed, and reused, relative to existing tattoos.

While certain embodiments are illustrated in the drawings and are described herein, including preferred embodiments, it is to be understood that the invention is not limited thereto and that it can be variously practiced with the scope of the following claims.

What is claimed is:

1. Reusable adhesive body apparel, comprising a stretchable decorative component configured to provide a decorative appearance to a body surface on which the apparel is applied, the stretchable decorative component comprising a non-adhesive surface and a substantially opposing adhesive surface; and an adhesive component coupled to the adhesive surface of the stretchable decorative component, the adhesive component being effective in facilitating adhesion of the stretchable decorative component to the body surface, the adhesive component formed of a material that enable the apparel to adhere to the body surface at least one additional time after removal from the body surface without substantial modification of the apparel.

2. The apparel of claim 1, wherein the decorative component is substantially flat when the body apparel is placed on a substantially flat surface.

3. The apparel of claim 1, wherein the decorative component comprises a decorative image provided on an adhesive tape.

4. The apparel of claim 3, wherein the decorative image is a print of a digital image.

5. The apparel of claim 3, wherein the decorative image is an image of an object selected from the group consisting of plants, animals, holiday characters, and spirals.

6. The apparel of claim 1, wherein the adhesive component comprises a water swellable polymer.

7. The apparel of claim 1, wherein the adhesive component comprises a hydrogel.

8. The apparel of claim 1, wherein the adhesive component comprises an opening positioned to provide a non-adhesive region on the body apparel.

9. The apparel of claim 8, wherein the opening is substantially located near the center of the apparel.

10. The apparel of claim 1, wherein the apparel is dimensioned to cover a nipple of a person.

11. The apparel of claim 1, wherein the apparel is selected from a group consisting of a costume, a bathing suit, and a tattoo.

12. The apparel of claim 1, wherein the adhesive component has a thickness less than about 0.04 inches.

13. The apparel of claim 1, wherein the non-adhesive surface of the decorative component includes a decorative image, and wherein the adhesive component comprises a hydrogel coupled to the adhesive surface of the decorative component.

14. The apparel of claim 1, wherein the decorative component consists of a decorative image provided on a non-adhesive surface of an elastic, non-woven tape; and wherein the adhesive component consists of a hydrogel layer placed on an adhesive surface of the elastic, non-woven tape.

15. The apparel of claim 14, wherein the tape is made of a material that permits gas to flow through the tape.

16. The apparel of claim 1, wherein the decorative component includes an exposed first surface when the apparel is applied to the body surface, and a non-exposed second surface coupled to the adhesive component, the exposed first surface having an uneven surface topography.

17. The apparel of claim 16, wherein the decorative component is a flower.

18. The apparel of claim 1, wherein the adhesive component comprises a material effective to adhere to the body surface of a person multiple times, and to be removed from the body surface without causing pain to the person.

19. The apparel of claim 1, wherein the adhesive component comprises a material effective to adhere to the body surface of a person multiple times without requiring substantial modification to the adhesive component or to the body surface.

20. The apparel of claim 1, wherein the adhesive component and the decorative component are laminated layers.

* * * * *